United States Patent [19]

Barrus et al.

[11] 4,258,623

[45] Mar. 31, 1981

[54] PRINT HAMMER MECHANISM HAVING DUAL ELECTROMAGNETIC COILS AND POLE PIECES

[75] Inventors: Gordon B. Barrus, El Segundo; Jerry Matula, Westminster, both of Calif.

[73] Assignee: Printronix, Inc., Irvine, Calif.

[21] Appl. No.: 7,788

[22] Filed: Jan. 30, 1979

[51] Int. Cl.[3] ..... B41J 7/70

[52] U.S. Cl. ..... 101/93.04; 101/93.48

[58] Field of Search ..... 101/93.02, 93.04, 93.09, 101/93.29–93.34, 93.48; 400/118, 121, 124; 346/78

[56] References Cited

U.S. PATENT DOCUMENTS

| | | | |
|---|---|---|---|
| 3,671,893 | 6/1972 | Edgar et al. | 101/93.48 X |
| 3,780,648 | 12/1973 | Curtiss et al. | 101/93.02 |
| 3,842,737 | 10/1974 | Gomi | 101/93.34 |
| 3,968,744 | 7/1976 | Kasu et al. | 101/93.02 |
| 4,033,255 | 7/1977 | Kleist et al. | 101/93.04 |
| 4,044,668 | 8/1977 | Barrus et al. | 101/93.04 |
| 4,114,532 | 9/1978 | Arzoumanian | 101/93.48 |
| 4,121,518 | 10/1978 | Prior et al. | 101/93.33 |

*Primary Examiner*—Edward M. Coven
*Attorney, Agent, or Firm*—Fraser and Bogucki

[57] ABSTRACT

In a print hammer mechanism in which an elongated, resilient hammer element mounted at a fixed end thereof has an opposite free end thereof selectively released from a retract position for impact of a dot imprinting element carried by the free end of the element, an improved magnetic circuit is provided for use in release and retraction of the hammer element. The improved magnetic circuit includes a pair of elongated pole pieces of like configuration having back ends thereof mounted on opposite sides of a rare earth magnet and tips at the opposite front ends thereof disposed adjacent the free end of the hammer element to form a pair of gaps therewith. Improved magnetic properties are provided by the presence of two gaps, the close proximity of the tips so as to minimize the high reluctance magnetic path through the hammer element and the maintenance of a small air gap between one of the tips and the hammer element when the element is in the retract position in contact with the other tip to facilitate quick release of the hammer element. The magnetic characteristics are even further improved by the physical design of the magnetic circuit which minimizes fringing magnetic fluxes and which utilizes a pair of magnetic coils, each of which is mounted on a different one of the pole pieces adjacent the tip thereof. The use of two coils provides for substantially complete cancellation of the magnetic fields in both gaps upon energization to provide for quicker release of the hammer element from the retract position.

1 Claim, 6 Drawing Figures

PRINT HAMMER MECHANISM HAVING DUAL ELECTROMAGNETIC COILS AND POLE PIECES

FIELD OF THE INVENTION

The present invention relates to line printers, and more particularly to print hammer mechanisms for controlling the operation of a plurality of resilient elongated hammer elements mounted within a reciprocating hammer bank and having dot matrix impacting elements mounted thereon.

HISTORY OF THE PRIOR ART

U.S. Pat. No. 3,941,051 of Barrus et al, issued Mar. 2, 1976 and commonly assigned with the present application, describes a dot matrix line printer having a reciprocating shuttle containing a hammer bank. Within the hammer bank a plurality of elongated, resilient, generally parallel hammer elements having dot impacting tips at the free ends thereof are selectively released from retracted positions so as to impact an ink ribbon against a platen supported print paper as the shuttle reciprocates relative to the print paper. The print hammer mechanism forms a magnetic circuit between the opposite fixed and free ends of the hammer elements and includes a common permanent magnet to which the hammer elements are coupled at their fixed ends, a common magnetic return path coupled to the permanent magnet opposite the hammer elements and a plurality of pole pieces, each of which extends outwardly from the magnetic return path so as to terminate in a pole tip facing the free end of the hammer element. Flux from the permanent magnet normally pulls the hammer element out of a neutral position and into a spring-loaded retract position against the pole piece. Each time a coil surrounding the pole piece is momentarily energized, the attracting force of the permanent magnet is overcome long enough to release the hammer element from the retract position and send if flying in the direction of the ink ribbon and print paper. Following impacting of the dot printing tip against the ribbon and paper, the hammer rebounds back into the spring-loaded retract position in preparation for the next energization of the coil.

A variation in the magnetic circuit of the arrangement disclosed in U.S. Pat. No. 3,941,051 of Barrus et al which provides certain improvements thereover is described in a co-pending application of Gordon G. Barrus, Ser. No. 911,989, PRINT HAMMER MECHANISM HAVING DUAL POLE PIECES, filed June 2, 1978 and commonly assigned with the present application. The Barrus application describes a hammer bank structure which is basically similar to that disclosed in U.S. Pat. No. 3,941,051 of Barrus et al but which utilizes a second pole piece in addition to the principal, coil carrying pole piece at the top of the magnetic circuit. The second pole piece extends upwardly from the bottom of the magnetic circuit so as to be spaced-apart from and generally parallel to the flexible hammer element before terminating in a tip adjacent both the first pole piece and the hammer element. The presence of the second pole piece provides various advantages including a low reluctance magnetic path in parallel with the high reluctance path defined by the hammer element so as to reduce the reluctance of the overall magnetic circuit. The presence of two gaps instead of one has been found to improve both the release and retracting characteristics of the hammer, particularly when a small gap of appropriate size is formed between the tip of the second pole piece and the hammer element when the hammer element is in the retract position against the tip of the first pole piece. Still further advantages derive from the presence of the two working air gaps including the ability to design the hammer elements for greater resonant frequency without at the same time having to redesign an existing magnetic circuit so as to increase the magnetic energy thereof.

The arrangement shown in co-pending application Ser. No. 911,989 of Barrus has been found to function effectively and efficiently for practically all applications of the line printer. However, there may be occasions where improvements in performance are desired. It may also be desirable to provide alternative physical arrangements providing certain advantages for certain applications. For example, it may be necessary for certain applications to reduce the fringing flux fields of the magnetic structure or to further reduce the hammer release time for a given magnetic strength and other magnetic characteristics.

Accordingly, it is an object of the invention to provide an improved print hammer mechanism.

It is a further object of the invention to provide an improved print hammer mechanism which minimizes fringing magnetic flux and which provides for rapid hammer release.

BRIEF DESCRIPTION OF THE INVENTION

These and other objects in accordance with the invention are accomplished by providing a print hammer mechanism having a magnetic circuit of highly compact configuration and having dual electromagnetic coils and pole pieces. A pair of pole pieces is disposed adjacent the free end of a resilient hammer element so as to form a pair of gaps with the hammer element. The pole pieces terminate at the hammer element in tips which are disposed relatively close to and yet spaced apart from each other. Consequently only a very small portion of the high reluctance path provided by the hammer element is included in the magnetic circuit. The close proximity of the pole piece tips is provided for by use of a relatively small and thin permanent magnet of high energy such as is provided by a rare earth magnet. The permanent magnet is disposed between the back ends of the opposite pole pieces opposite the hammer element.

The configuration of the magnetic circuit is such that stray flux fields between the opposite poles of the permanent magnet are principally confined to small regions at the opposite ends of the permanent magnet, minimizing the interference of such fields with the hammer element and the release characteristics thereof. This provides the hammer element with a high, more uniform velocity profile. The effects of fringing magnetic flux are also minimized by the absence of a further magnetic path such as the lower portion of the hammer element in parallel magnetic circuit with the lower pole piece, which feature has the effect of altering the release characteristics of the magnetic circuit to provide for quicker and easier release.

The presence of two separate coils in connection with the two different pole pieces provides even further enhancement of the release characteristics of the resilient hammer element. The provision of a separate coil with each pole piece close to the gap formed at the tip thereof results in substantially complete and rapid cancellation of the flux in the gaps between the pole piece tips and the hammer element upon energization of the coils to provide quicker hammer release.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
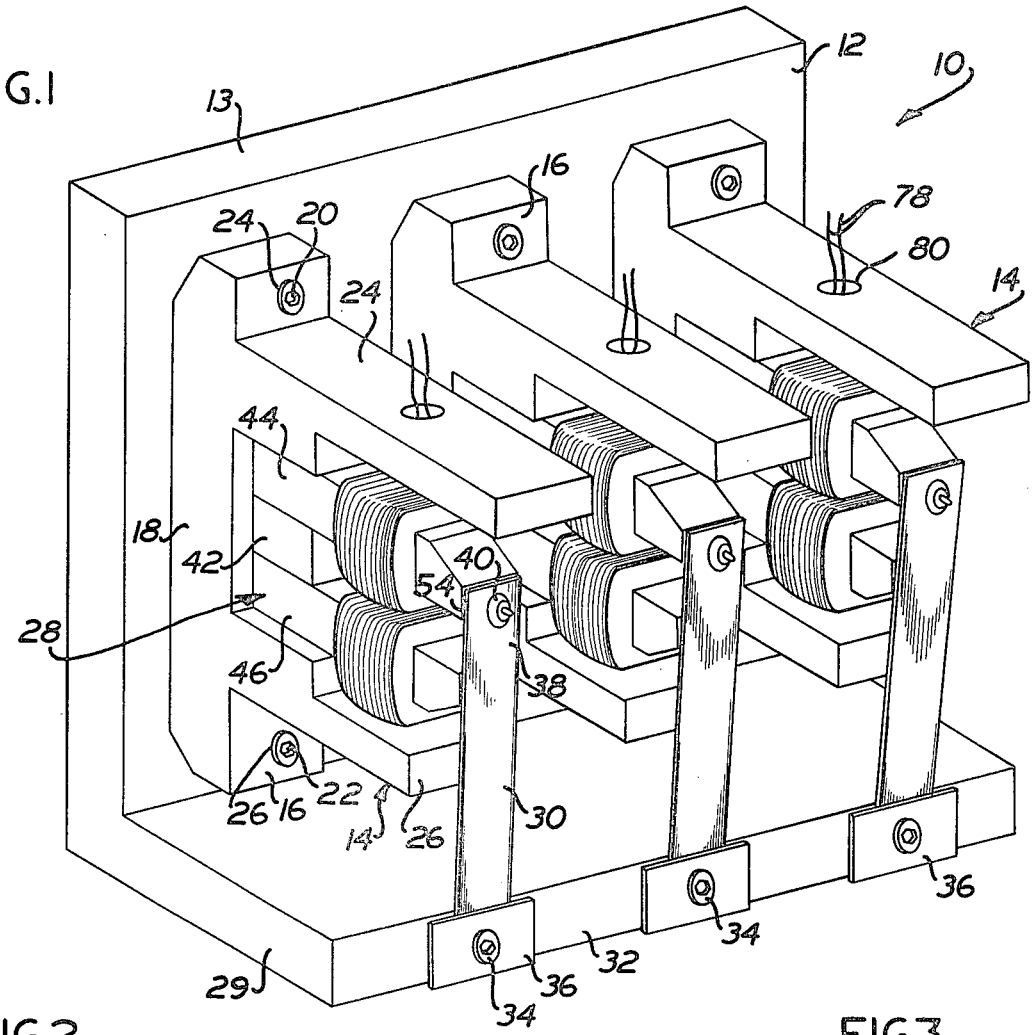
FIG. 1 is a perspective view of a hammer bank in accordance with the invention.

FIG. 1 depicts a hammer bank 10 in accordance with the invention. The hammer bank 10 includes an elongated back frame 12 of generally L-shaped cross-section having a plurality of print hammer mechanisms mounted along the length of the upper, generally vertically disposed main portion 13 thereof. The back frame 12 which is of aluminum or other non-magnetic, heat sink material provides for mounting the hammer bank 10 on a shuttle assembly for bidirectional, reciprocating motion of the hammer bank 10 and included print hammer mechanism 14 relative to a paper or other printable medium in a line printer.

Each of the print hammer mechanisms 14 includes a hammer mounting frame 16 of aluminum or other non-magnetic, heat dissipating material having a generally vertically disposed rear portion 18 thereof joined to the main portion 13 of the back frame 12 at the top and bottom thereof by screws 20 and 22 extending through apertures 24 and 26 respectively in the rear portion 18. The rear portions 18 of the various hammer mounting frames 16 of the print hammer mechanisms 14 are mounted in generally parallel, spaced-apart relation along the length of the main portion 13 of the back frame 12.

Each of the hammer mounting frames 16 has top and bottom portions 24 and 26 respectively which extend outwardly from the rear portion 18 adjacent the top and bottom of the rear portion 18 and at generally right angles relative to the rear portion 18. The top and bottom portions 24 and 26 serve to partially surround and mount a magnetic circuit 28 therebetween.

The back frame 12 has a bottom portion 29 extending outwardly from the main portion 13 and mounting a plurality of spring strips 30 in spaced-apart relation at an outer edge 32 thereof. Each spring strip 30 is mounted by a screw 34 extending through a mounting plate 36 and lower fixed end at the spring strip and into the outer edge 32 of the bottom portion 29. The spring strip 30 has an opposite upper free end 38 which mounts a dot matrix printing tip 40.

The magnetic circuits 28 utilize the rear portion 18 and the top and bottom portions 24 and 26 of the hammer mounting frame 16 for support only. The magnetic path for each magnetic circuit 28 is essentially confined to a permanent magnet 42, and a pair of opposite pole pieces 44 and 46 forming each magnetic circuit 28 together with the adjacent portion of the upper, free end 38 of the elongated spring strip 30.

Figure 4:
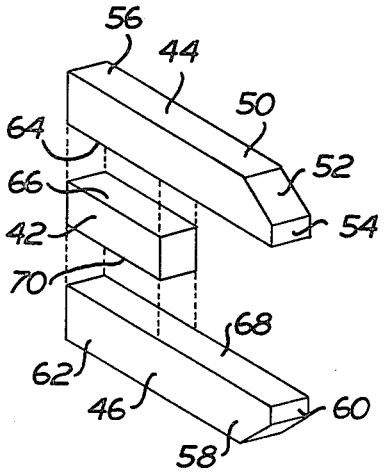
FIG. 4 is a perspective, exploded view of an opposite pair of pole pieces and intermediate permanent magnet forming a magnetic circuit in the print hammer mechanism of FIG. 3.

As seen in FIG. 4 the pole pieces 44 and 46 are elongated and of like configuration. The upper pole piece 44 has a front end 50 thereof which is beveled at a surface 52 so as to terminate in a tip 54 of reduced size. The tip 54 has a large enough area to provide the amount of flux necessary to retract the hammer. The generally rectangular cross-section of the pole piece 44 along the length of the pole piece behind the tip 54 is of sufficient area to prevent saturation. The beveling at the tip 54 reduces the leakage flux. At the opposite end of the upper pole piece 44 is a back end 56. In similar fashion the lower pole piece 46 has a front end 58 terminating in a tip 60, and a back end 62. The upper pole piece 44 has a flat, rectangular bottom surface 64 which is disposed in contact with and is generally coextensive with a top surface 66 of the permanent magnet 42 at the back end 56 of the piece 44. The lower pole piece 46 which is inverted relative to the upper pole piece 44 has a flat, rectangular top surface 68 disposed in contact with and generally coextensive with a bottom surface 70 of the permanent magnet 42 in the region of the back end 62 of the pole piece 46.

Accordingly, the magnetic circuit 28 comprises a compact sandwich arrangement taking up little space and at the same time comprising the entire magnetic circuit when combined with the upper free end 38 of the elongated spring strip 30. The use of a rare earth magnet as the permanent magnet 42 allows for this compact design while at the same time providing the necessary magnetic field strength to hold the elongated spring strip 30 in the retract position. Moreover, the uniform thin dimension of the rare earth magnet 42 between the opposite surfaces 66 and 70 enables placement of the pole pieces 44 and 46 with the tips 54 and 60 thereof relatively close together so that only a very small portion of the upper free end 38 of the elongated spring strip 30 need be included in the magnetic flux path. Such flux path is shown by a dashed line 70 in FIG. 5.

An electromagnetic coil 74 surrounds and is mounted on the upper pole piece 44 at the front end 50 thereof. In like fashion a coil 76 is mounted on the lower pole piece 46 at the front end 58 thereof. The coils 74 and 76 are coupled to leads 78 which extend upwardly through an aperture 80 in the top portion 24 of the hammer mounting frame 18 where they are connected to electrical energizing circuits via a wire bus (not shown). The upper portion 24 of the frame 18 is reduced in thickness at the outer region thereof to provide clearance for the coil 74 while at the same time abutting the back portion 56 of the upper pole piece 44. The lower portion 26 is similarly configured so as to clear the coil 76 and at the same time abut the back portion 62 of the lower pole piece 46. The magnetic circuit 28 comprising the magnet 42, the pole pieces 44 and 46 and the coils 74 and 76 is covered with an epoxy potting compound while seated in the hammer mounting frame 16 to help secure it in place and protect it.

Figure 5:
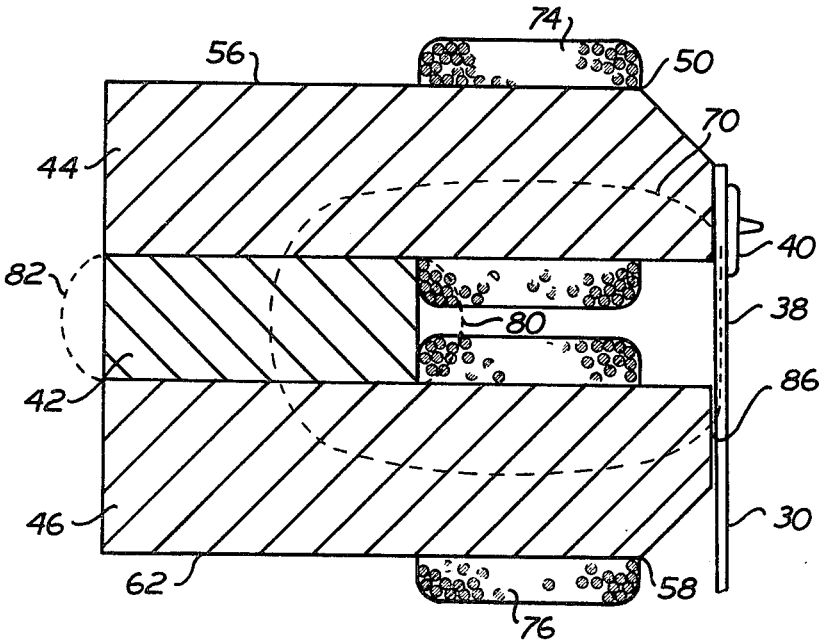
FIG. 5 is a sectional view of the arrangement of FIG. 4 assembled and with coils added and disposed in operative relationship with a hammer element.

The effects of stray, fringing flux in prior art hammer release mechanisms can be substantial. For example, in the structure shown in previously referred to copending application Ser. No. 911,989 of Barrus, the permanent magnet is of sufficiently large size and is so located that there is substantial stray flux between the opposite poles thereof in the upper regions of the structure and in the vicinity of the hammer spring strip so as to influence the release and other characteristics of the spring strip. In the present invention, as illustrated in FIG. 5, stray, fringing flux between the opposite poles of the magnet 42 at the opposite surfaces 66 and 70 thereof is essentially confined to the regions adjacent the opposite ends of the magnet 42 as shown by dashed lines 80 and 82 in FIG. 5. These fields have virtually no influence on the operation of the spring strip 30.

Figure 2:
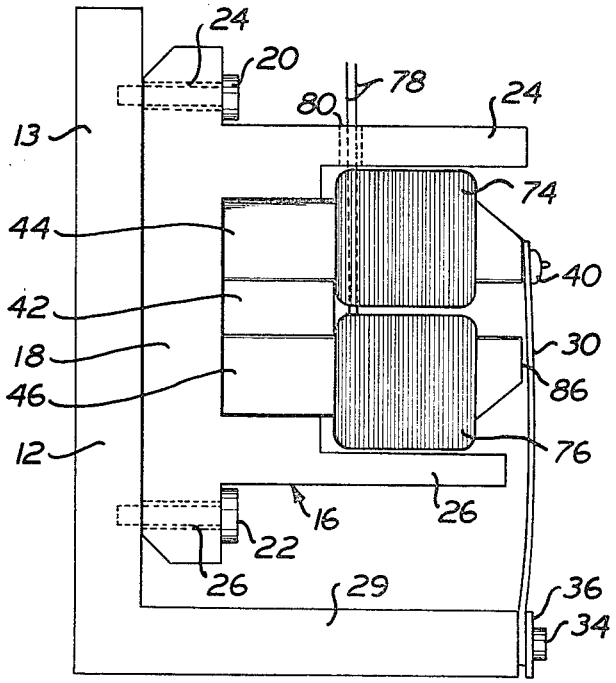
FIG. 2 is an end view of the hammer bank of FIG. 1.
Figure 3:
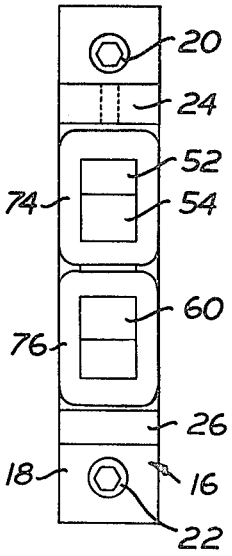
FIG. 3 is a front view of one of the print hammer mechanisms of the hammer bank of FIG. 1 with the hammer spring strip removed therefrom for clarity of illustration.

Release of the elongated spring strip 30 from the retract position shown in FIGS. 2 and 5 is accomplished by the momentary energization of the coils 74 and 76. This momentary energization cancels the flux from the permanent magnet 42, thereby releasing the elongated spring strip 30 and allowing it to flex outwardly and away from the pole tips 54 and 60 until the dot matrix printing tip 40 impacts the print paper and included ribbon. Upon impact the elongated spring strip 30 rebounds into contact with the magnetic circuit 28 where it is held in the retract position by virtue of the permanent magnet 42.

As best seen in FIGS. 2 and 5 a small air gap 86 exists between the elongated spring strip 30 and the tip 60 of the lower pole piece 46 when the hammer is in the retract position with the strip 30 held in contact with the tip 54 of the upper pole piece 44 by the permanent magnet 42. As described in previously referred to copending application Ser. No. 911,989 of Barrus, maintenance of a small air gap at one of two pole pieces is advantageous in improving the release characteristics of the hammer. In the present example the attractive force exerted by the permanent magnet 42 on the hammer is a maximum of about 1.6 lbs. when the gap 86 is nonexistent and decreases with increasing size of the gap 86. A gap size of approximately 3 mils is preferred and provides an attractive force on the spring strip 30 of approximately 0.86 lbs. Larger gaps with the consequent reduction in attractive force pose hammer retract problems. Smaller gaps require excessive amounts of energizing current to the coils 74 and 76 to effect a desired hammer release characteristic.

The magnetic circuit 28 in accordance with the invention provides a further advantage when contrasted with the arrangement shown in copending application Ser. No. 911,989 of Barrus in which the lower portion of the hammer spring strip forms a magnetic path in parallel with the path formed by the lower pole pieces in that arrangement. In the arrangement of the invention the permanent magnet 42 is confined to the space directly between the pole pieces 44 and 46. At the same time the hammer spring strip 30 is mounted on the nonmagnetic portion 29 of the frame 12 well away from the magnet 42. Accordingly, the release characteristic is altered to provide faster and easier release of the hammer spring strip 30.

Figure 6:
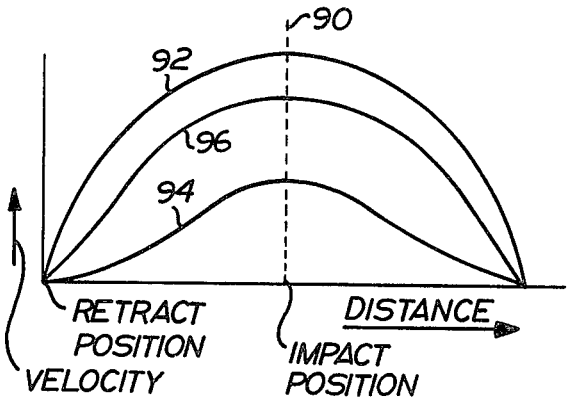
FIG. 6 comprises diagrammatic plots of velocity of the hammer element as a function of distance for print hammer mechanisms in accordance with the invention as contrasted with mechanisms of the prior art.

FIG. 6 depicts several different velocity profiles for the hammer in which hammer velocity is plotted as a function of the distance that the dot matrix printing tip 40 travels as the hammer is released from the retract position and flies toward the neutral position where the tip 40 impacts the paper. The impact position is represented by a vertical dashed line 90. The portions of the velocity profiles to the right of the line 90 represent the velocity if the hammer did not impact the paper but instead was free to flex in a direction opposite the neutral position from the retract position.

A first curve 92 represents an ideal velocity profile. In this case the velocity of the hammer quickly increases to a peak of large velocity as the hammer moves out of the retract position, then decreases in complementary fashion to zero if allowed to flex to the opposite extreme. The ideal velocity profile 92 assumes a hammer magnetic circuit of very high efficiency and in which such things as fringing flux fields are not a factor. In actual practice the velocity profile is more like a curve 94 shown in FIG. 6 where the velocity increases more slowly upon hammer release and to a peak value which is substantially less than in the case of the ideal profile 92. The differences between the profiles 92 and 94 may be due to a number of factors including design of the hammer magnetic circuit and the effects of fringing flux. The profile 94 is typical of prior art magnetic circuits in which fringing fields typcially play a major role and which do not have the benefit of dual coils combined with dual pole pieces and gaps as in the case of the invention.

A typical velocity profile of magnetic circuits in accordance with the invention is represented by a curve 96 in FIG. 6. Due largely to the presence of the two coils in conjunction with a pair of pole pieces and an overall design which minimizes fringing fields, the peak of the profile 96 is substantially higher than in the case of the curve 94. This is due largely to the improvement in hammer release as provided by the characteristics of the magnetic circuit.

The higher velocities provided by hammer magnetic circuits in accordance with the invention result in a number of advantages including greater impact force of the dot matrix printing tip 40 when impacting the paper. For example, the hammer arrangement shown in previously referred to U.S. Pat. No. 3,941,051 of Barrus et al provides an impact force of approximately 28 lbs. The hammer arrangement shown in previously referred to co-pending application Ser. No. 911,989 of Barrus provides an impact force of 35–38 lbs. Finally, magnetic circuits in accordance with the present invention have been found to provide an impact force of approximately 50 lbs.

The pole pieces 40 and 42 in addition to the elongated spring strip 30 are made of appropriate magnetic material such as steel. The permanent magnet 38 is preferably of the rare earth type. An example of such a magnet which provides the necessary magnetic force is a samarium cobalt magnet. Such a magnet having a strength of about 20 million gauss-oersteds is manufactured by TDK Electronics Co. Ltd.

While the invention has been particularly shown and described with reference to a preferred embodiment thereof, it will be understood by those skilled in the art that various changes in form and details may be made therein without departing from the spirit and scope of the invention.

What is claimed is:

1. A multiple hammer bank for a dot printer comprising:

a back frame having a main portion and a bottom portion;

a plurality of mounting frames mounted in spaced-apart relation along the main portion of the back frame and each having upper and lower portions thereof extending outwardly from a generally vertically disposed rear portion;

a plurality of elongated, flat, substantially parallel, magnetic spring hammer elements of resilient material disposed in spaced-apart relation along the length of the back frame with the lower fixed end of each hammer element being mounted on the bottom portion of the back frame and an opposite upper free end of each hammer element being free to flex back and forth relative to a different one of the mounting frames, each hammer element assuming a relatively straight configuration defining a neutral position when not flexed; and a plurality of magnetic circuits, each being mounted on a different one of the mounting frames and including a rare earth magnet disposed adjacent the vertically disposed rear portion of the mounting frame between the upper and lower portion of the mounting frame, a pair of opposite pole pieces mounted on opposite sides of the rare earth magnet between the rare earth magnet and the upper and lower portions of the mounting frame and extending outwardly from the vertically disposed rear portion of the mounting frame to a location adjacent the upper free end of the hammer element mounted on the hammer mounting frame, each of the pair of pole pieces having surfaces extending from a back end of the pole piece to an opposite tip and the rare earth magnet having a pair of opposite surfaces disposed in contact with and generally coextensive with the surface of each pole piece along the back end thereof, one of the pair of pole pieces receiving the upper free end of the hammer element and the other one of the pair of pole pieces forming an air gap with the upper free end of the hammer element when the hammer element is in a spring-loaded retract position in which the strip is flexed out of the neutral position and assumes a curved configuration, the rare earth magnet establishing a magnetic field normally maintaining the hammer element in the spring-loaded retract position, and a pair of electromagnetic coils, each mounted on a different one of the pair of pole pieces, the electromagnetic coils being operative when energized to release the hammer element for flight away from the spring-loaded retract position, the resilient material of the hammer element combining with the magnetic field of the rare earth magnet to return the hammer element to the spring-loaded retract position following release of the hammer element and impact of a printable medium by the upper free end of the hammer element.

* * * * *